United States Patent [19]

Ogles

[11] 4,201,115

[45] May 6, 1980

[54] OIL WELL PUMP JACK WITH DUAL HYDRAULIC OPERATING CYLINDERS

[76] Inventor: Ethridge F. Ogles, Rte. 4, Box 201, Ada, Okla. 74820

[21] Appl. No.: 923,666

[22] Filed: Jul. 11, 1978

[51] Int. Cl.[2] ..... F01L 15/00; F16D 31/00

[52] U.S. Cl. ..... 91/218; 91/303; 60/369; 60/379; 60/456; 74/590

[58] Field of Search ..... 60/369, 371, 379, 456; 91/218, 277, 281, 286, 303; 74/590; 91/508, 533

[56] References Cited

U.S. PATENT DOCUMENTS

| | | | |
|---|---|---|---|
| 2,131,910 | 10/1938 | Vernon et al. | 91/338 |
| 2,232,449 | 2/1941 | Habenicht | 60/369 X |
| 2,550,723 | 5/1951 | Ross | 60/369 X |
| 2,704,998 | 3/1955 | Day et al. | 60/369 |
| 3,175,513 | 3/1965 | Dulaney | 74/590 |
| 3,221,568 | 12/1965 | Ross | 74/106 |
| 3,369,490 | 2/1968 | Hawk | 60/372 X |
| 3,405,605 | 10/1968 | Ross | 91/173 |
| 3,884,095 | 5/1975 | Miyao | 60/484 X |
| 3,971,213 | 7/1976 | Kelley | 60/372 |

*Primary Examiner*—Edgar W. Geoghegan

[57] ABSTRACT

An oil well pump jack with dual hydraulically operated piston and cylinder assemblies for pivoting the walking beam of the pump jack and including a unique control arrangement for controlling operation of the piston and cylinder assemblies. The pump jack includes a unique base or skid and an adjustable knee brace assembly to facilitate positioning of the pump jack in properly supported relation to the oil well at the oil well site. The control arrangement for the piston and cylinder assemblies includes a reversing valve, a linkage mechanism for operating the reversing valve to cause controlled oscillation of the walking beam and a cushioning device for controlling acceleration and deceleration of the oscillating walking beam to reduce abrupt tension forces exerted on the polish rod and sucker rods and impact forces imparted to the pump jack during oscillation of the walking beam. The control arrangement also enables the hydraulic piston and cylinder assemblies to be operated in a double acting mode or a single acting mode and includes a lockout device to convert automatic operation of the pump jack to manual operation thereof.

10 Claims, 9 Drawing Figures

OIL WELL PUMP JACK WITH DUAL HYDRAULIC OPERATING CYLINDERS

CROSS-REFERENCE TO RELATED APPLICATION

The invention disclosed in this application represents improvements made in my copending application Serial No. 724,529, filed Sept. 20, 1976, for Hydraulically Operated Oil Well Pump Jack now U.S. Pat. No. 4,099,447, issued July 11, 1978.

BACKGROUND OF THE INVENTION

1. Field of the Invention

The present invention generally relates to a pump jack and more particularly to a pump jack operated by dual hydraulically operated rams each of which includes a piston and cylinder assembly and a control arrangement for controlling the pivotal movement of a walking beam in a manner to render the operation of the pump jack more efficient, with less repair and maintenance and for a longer life expectancy with the pump jack also including a base having a pivotal section adjustable by a brace arrangement to facilitate installation of the pump jack at a well site.

2. Description of the Prior Art

Pump jacks for use in combination with oil wells have been used for many years and most of those presently being used include a pivotal walking beam supported from a stanchion or samson post by a saddle bearing with the end of the beam overlying the oil well having a horse head thereon to which a wire rope or cable bail assembly is connected for securing the walking beam to the upper end of a polish rod for reciprocating the polish rod, sucker rods and downhole pump. The walking beam usually is driven by pitman arms or rods which in turn are connected to eccentric cranks on a crank shaft driven from a prime mover through a reduction gear arrangement with counterbalance devices being associated with the mechanism. Such devices are relatively expensive and heavy in weight due to the large reduction gear unit and counterbalance unit employed thereon and have required substantial maintenance time and repair costs to retain the pump jack in properly adjusted operating condition. Also, such devices exert substantial abrupt tension forces on the polish rod and sucker rods as well as impact forces on the components of the pump jack which has resulted in excessive wear and fatigue breakage of various components.

Efforts have been made to provide fluid power operated piston and cylinder assemblies for operating the pump jack. The following U.S. patents relate to pump jacks and operating mechanisms therefor and which are all cited in my copending application:

U.S. Pat. Nos.:

2,131,910—Vernon et al—October, 1938
2,232,449—Habenicht—February, 1941
2,550,723—Ross—May, 1951
2,704,998—Day et al—March, 1955
3,175,513—Dulaney—March, 1965
3,369,490—Hawk—February, 1968
3,221,568—Ross—December, 1965
3,405,605—Ross—October, 1968
3,971,213—Kelley—July, 1976.

SUMMARY OF THE INVENTION

An object of the present invention is to provide a pump jack for oil wells or other fluid producing wells utilizing a reciprocating pump actuated by a pivotal walking beam connected with the reciprocating pump with the walking beam being pivoted or oscillated by a pair of hydraulically operated piston and cylinder assemblies located on opposite sides of a transverse pivotal axis defined by a saddle bearing supporting the walking beam from the upper end of a stanchion or samson post.

Another object of the invention is to provide a hydraulically operated pump jack in accordance with the preceding object in which a prime mover and hydraulic pump is connected with the piston and cylinder assemblies through a reversing valve automatically controlled by an adjustable linkage mechanism connecting the reversing valve and the walking beam with the linkage mechanism also enabling manual operation of the reversing valve.

Still another object of the invention is to provide a hydraulically operated pump jack in accordance with the preceding objects in which a cushioning device is incorporated in the hydraulic system between the reversing valve and piston and cylinder assemblies for reducing initial acceleration of the piston and the piston and cylinder assemblies operating the beam thereby reducing initial acceleration of the beam with the cushioning fluid pressure being subsequently used to increase acceleration of the beam after a lower initial acceleration thereby reducing stresses on the pump operating mechanism as well as the pump jack structure.

A further object of the invention is to provide a hydraulically operated pump jack in which the linkage interconnecting the reversing valve and walking beam is hydraulically controlled and the characteristics of the linkage mechanism may be varied by an adjusting needle valve assembly controlling an over center spring bias mechanism to assure controlled movement of the reversing valve and corresponding control of movement of the pressurized fluid to the hydraulically operated piston and cylinder assemblies.

A still further object of the present invention is to provide a pump jack in accordance with the preceding objects in which the base of the pump is provided with a pivotal portion thereon which is closely associated with the oil well being adjustable by adjustable brace members extending to the stanchion or samson post to facilitate stationary support of the pump jack in an accurate relationship to the oil well thereby reducing the time required for installation of the pump jack at the oil well site.

Another significant object of the present invention is to provide a hydraulically operated pump jack having substantially less total weight and substantially less initial cost as compared with a conventional pump jack and requiring substantially less maintenance and increasing the over-all efficiency of pumping fluid from a producing well.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figures 1, 3:
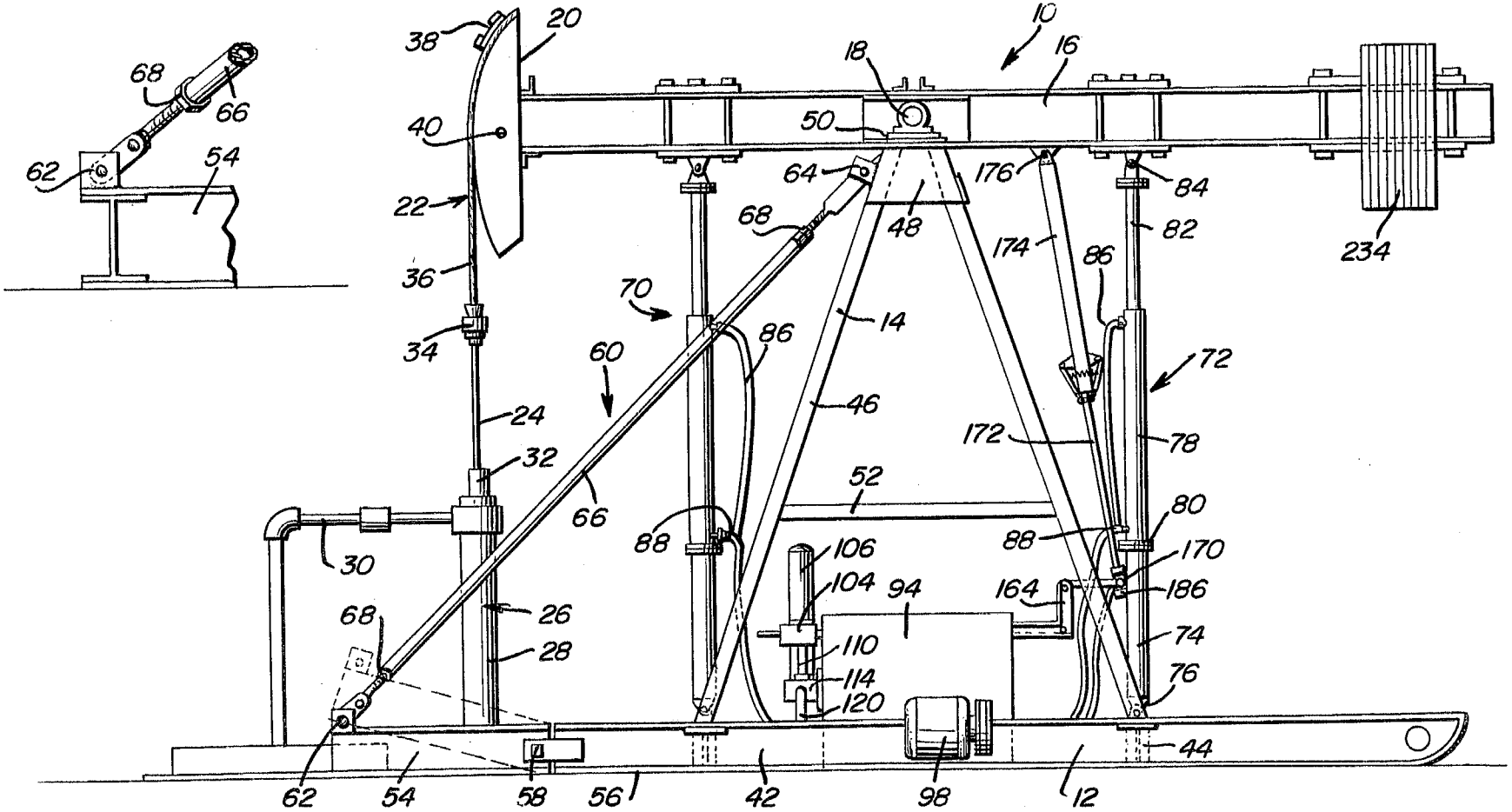
FIG. 1 is a side elevational view of the oil well pump jack of the present invention illustrating the association of the components.
FIG. 3 is a fragmental view of the brace and pivotal portion of the skid.
Figure 2:
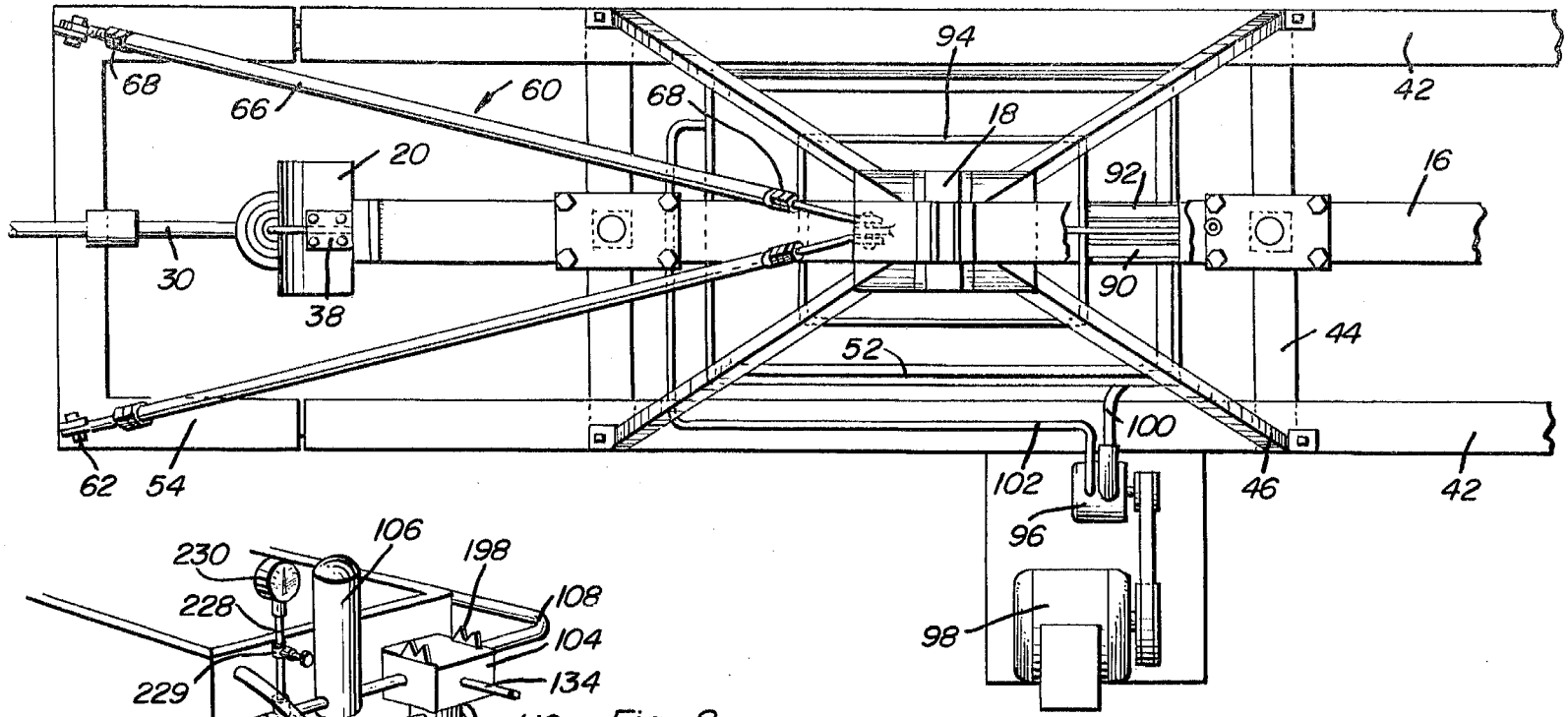
FIG. 2 is a top plan view thereof.
Figure 9:
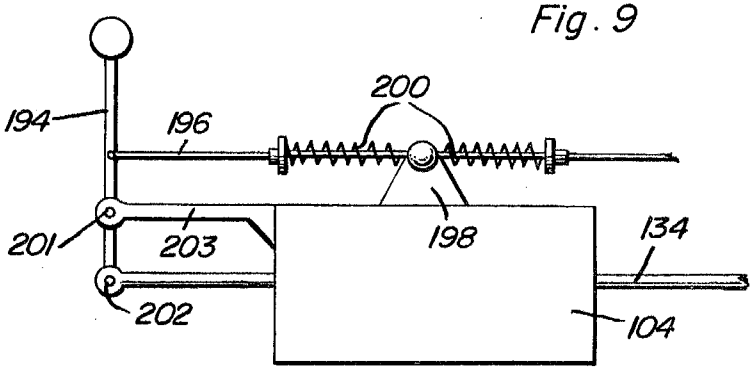
FIG. 9 is a fragmental view of the reversing valve with handle.
Figure 8:
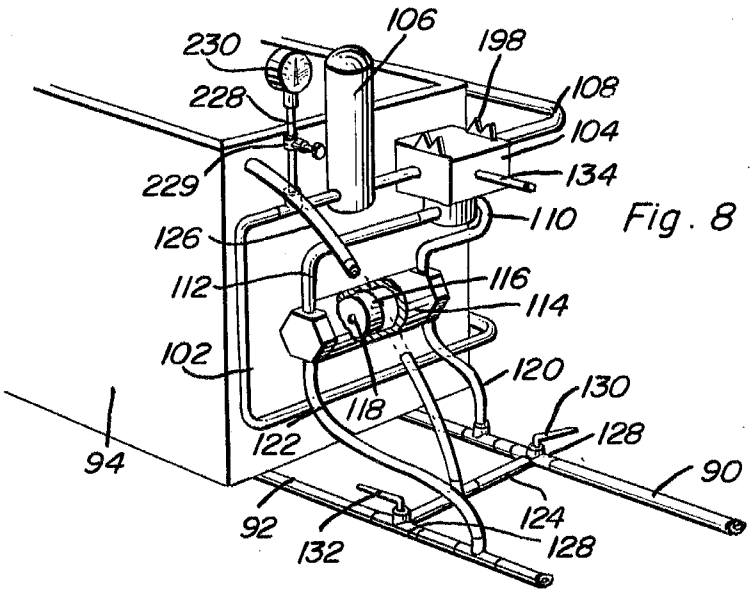
FIG. 8 is a perspective view of the end of the reservoir illustrating the reversing valve, cushioning arrangement and associated conduits.
Figures 4, 5, 6, 7:
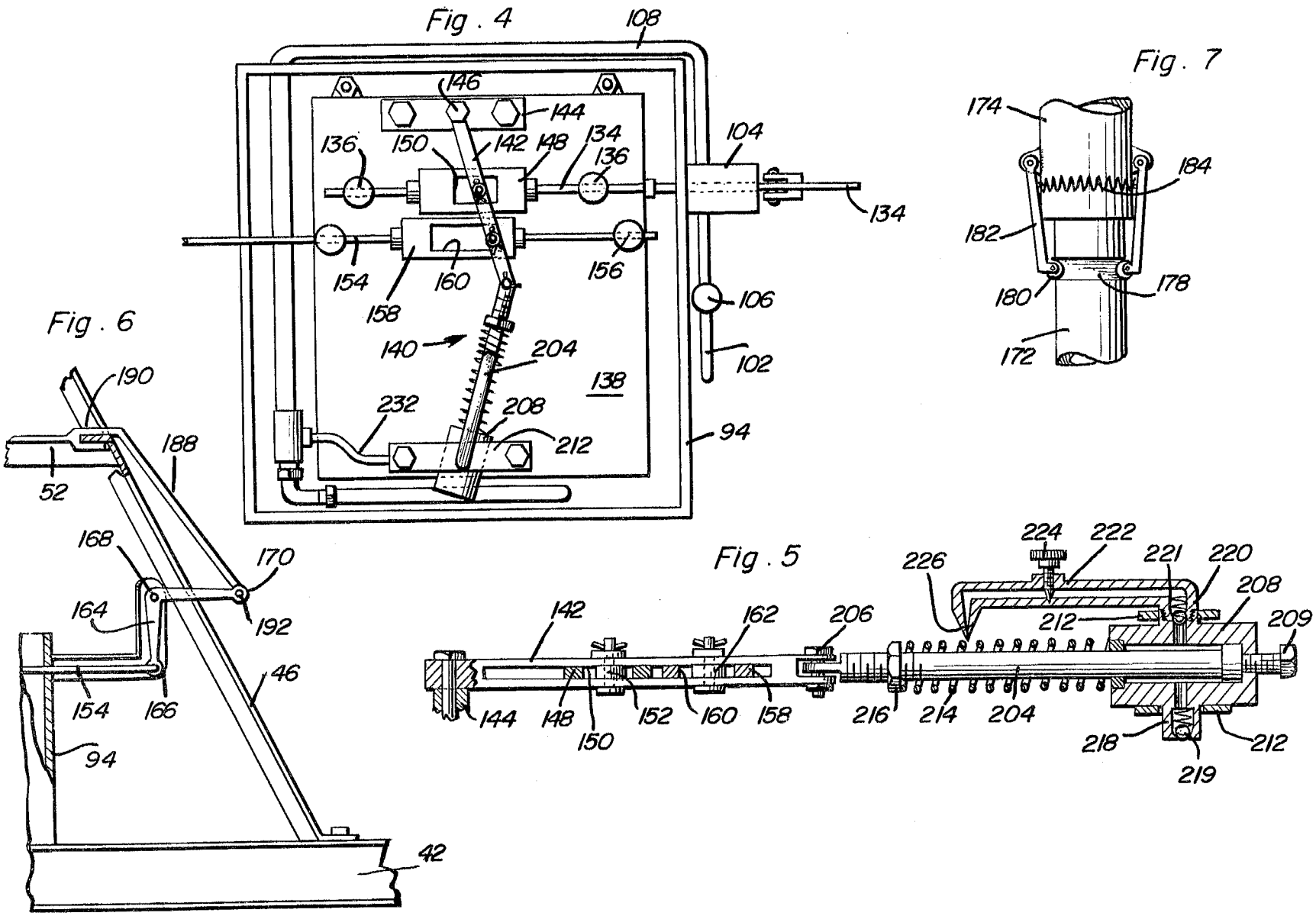
FIG. 4 is a top plan view of the reversing valve control.
FIG. 5 is a sectional view of the control linkage.
FIG. 6 is a fragmental view of the lockout device.
FIG. 7 is a fragmental view of the linkage actuating rod.

The pump jack of the present invention is generally designated by numeral 10 and includes a supporting base or skid 12 to which is connected a rigid upstanding stanchion or samson post 14 supporting a walking beam 16 at its upper end by the use of a saddle bearing or central bearing assembly 18. One end of the walking beam 16 is provided with a horse head 20 to which is attached a wire rope bail assembly or bridle 22 that is connected with a polish rod 24 extending into an oil well or other production well 26 in a conventional manner which has been schematically illustrated with the well 26 including a casing 28 having a production pipeline 30 connected thereto and a stuffing box assembly 32 on the upper end thereof which receives the polish rod 24 in a conventional manner. A carrier bar and polish rod clamp assembly 34 connects the cables 36 of the wire rope or bail assembly or bridle 22 with the polish rod 24 in a conventional manner and a wire rope or bail hanger 38 connects the cables 36 to the upper end of the horse head 20 in a well known manner. The structure of the horse head and its relationship to the oil well including the polish rod, sucker rods attached to the polish rod and the downhole pump, production tubing and the like, are all conventional with the horse head being attached and detachably secured to the walking beam by a suitable means such as a bolt arrangement 40. Also, this structure is disclosed in my copending application Ser. No. 724,529 which disclosure is incorporated herein by reference thereto.

The base or skid 12 may conveniently be longitudinal structural members, such as I-beams, or the like, 42 rigidly interconnected by transverse members 44 welded thereto, or the like, and the stanchion or samson post 14 may conveniently be in the form of upwardly converging angle iron members 46 rigidly fixed to the base at the lower end thereof and braced by brace members 48 and interconnected at their upper ends by a supporting plate 50 for the saddle bearing assembly 18. A center brace assembly 52 may be provided for the upwardly converging angle iron members 46, thus providing a rigid base and supporting assembly for the walking beam 16 which is in the form of an I-beam having a portion of the saddle bearing assembly 18 rigidly fixed to the undersurface thereof for oscillation about a transverse axis, so that the horse head 20 moves in an arcuate path with the outer arcuate surface of the horse head 20 reciprocating the polish rod 24 in a vertical path in a well-known manner.

The base or skid 12 includes a pivotal end portion defined by end portions 54 of the I-beams 42 being separated from and pivotally anchored to the I-beams 42 by a pair of rigid bracket plates 56 and an attaching bolt 58, so that the end of the skid adjacent the oil well 26 may be pivoted to some extent to facilitate positioning of the pump jack on the supporting surface adjacent the well site by conforming the I-beams 42 with the underlying terrain. Each of the pivotal portions 54 of the I-beams 42 are individually adjusted and locked in position by a pair of brace assemblies 60 which includes a pivotal connection to lugs on the extending portion 54 at 62 and to the plate or upper end of the stanchion of samson post at 64 and a central portion 66 which is longitudinally adjustable by suitable screw threaded connecting means and lock nuts at either or both ends of the brace 60 as indicated by numeral 68. This enables independent limited adjustment of the pivotal portions 54 of the I-beams 42 to facilitate accurate positioning of the pump jack and particularly the horse head with respect to the polish rod and oil well.

For oscillating the walking beam 16 about the transverse axis defined by the saddle bearing 18, a pair of hydraulically operated piston and cylinder assemblies 70 and 72 interconnect the walking beam 16 and base or skid 12 on opposite sides of and equally spaced from the transverse pivot axis defined by the saddle bearing 18. Each of the piston and cylinder assemblies 70 and 72 includes a supporting pedestal 74 pivotally connected to a cross brace 44 by a suitable pivot connection 76 and extending upwardly from the base of skid 12 and rigidly attached to the lower end of a cylinder 78 by suitable bolted type plate connection 80. The upper end of the cylinder 78 includes a piston rod 82 extending therefrom with the piston rod including a piston (not shown) reciprocal in the cylinder 78 with the upper end of the piston rod 82 being pivotally connected to the walking beam 16 as at 84. Also, the cylinder 76 is provided with a conduit 88 communicating with the lower end thereof and a conduit 86 communicating with the upper end thereof to enable the piston and cylinder assemblies 70 and 72 to be operated in a double acting mode or in a single acting mode as described hereinafter.

The conduits 86 and 88 are interconnected by longitudinal conduits 90 and 92, respectively, which extend from front to rear of the skid 12 and in underlying relation to a generally square or rectangular oil reservoir 94 mounted centrally within the stanchion or samson post 14 and supported on the base or skid 12 in any suitable manner and which is adapted to receive a supply of hydraulic fluid used in operating the piston and cylinder assemblies 70 and 72 when oscillating the walking beam 16. For supplying pressurized hydraulic fluid from the reservoir 94, a hydraulic pump 96 driven by a prime mover, such as an electric motor 98, is mounted on the base or skid 12 in any suitable manner with the pump being communicated with the reservoir 94 through an intake conduit 100 which may be communicated with the reservoir 94 in any suitable manner and provided with any suitable screens, check valves, and the like. The specific construction of the pump is conventional and a discharge conduit 102 extends from the pump to a reversing valve 104 mounted horizontally at the upper end portion of the forward wall of the reservoir 94 with the discharge conduit 102 being provided with a check valve, flowmeter and pneumatic shock absorbing device 106 which absorbs pulsations imparted to the hydraulic fluid by the pump thereby producing a fluid pressure to the reversing valve 104 with minimum fluctuations in pressure. The particular location of the pump and electric motor may be varied and the specific construction and location of the check valve, flowmeter and shock absorber may also be varied and various types of prime movers may be utilized including internal combustion engines of a relatively small horse power, such as an air cooled, gasoline powered engine. Such devices may be mounted on the skid or base or in any other desired location and any suitable housing or protecting device may be provided to protect the motor during periods of inclement weather.

The reversing valve 104 is provided with a discharge conduit 108 extending back into the upper end of the reservoir 94 so that when the reversing valve is in a centered position, hydraulic fluid pressure is circulated through the reversing valve back into the reservoir 94. Also, the reversing valve 104 is provided with two conduits 110 and 112 communicating with opposite ends of a cushioning cylinder 114 which is horizontally disposed and mounted transversely from the forward wall of the reservoir 94 below the reversing valve 104. The cushioning cylinder 114 includes a free-floating piston 116 positioned therein with the piston including an orifice 118 therein which communicates the chambers on opposite sides of the piston 116 with each other with limited flow therebetween controlled by the size of the orifice 118. Thus, as hydraulic pressure enters the cushioning cylinder 114 from one of the conduits 110 or 112, the piston 116 will be moved in the opposite direction to increase the hydraulic pressure in the opposite chamber within the cushioning cylinder 114 with the orifice 118 enabling flow of hydraulic fluid therethrough from the high pressure side to a lower pressure side so that movement of the free piston 116 will be modified or reduced since a portion of the high pressure fluid will flow through the orifice 118 in one direction during initial pressuring of hydraulic fluid in one chamber of the cushioning cylinder 114 and when the reversing valve 104 is reversed, the orifice 118 will function in an opposite manner to modify or retard movement of the piston 116 in the opposite direction. The cushioning cylinder 114 has the ends thereof communicated with the connecting conduits 90 and 92, respectively, by conduits 120 and 122 connected with the ends of the cushioning cylinder 114 on opposite sides of a connecting conduit 124 which extends between the conduits 90 and 92 and has a return conduit 126 connected centrally thereof which extends back to the reservoir 94 to enable return of hydraulic fluid to the reservoir when the piston and cylinder assemblies 70 and 72 are operating in a single acting mode. Each end of the connecting conduit 14 includes a T-coupling 128 each of which is provided with a bypass valve 130 and 132, respectively, with the bypass valves being manually movable to bypass fluid flow from the conduit 90 into the connecting conduit 124 and from the conduit 92 into the connecting conduit 124, respectively, thus enabling each of the piston and cylinder assemblies 70 and 72 to be operated in a single acting mode.

The reversing valve 104 includes an operating rod 134 connected thereto so that when the rod 134 is reciprocated to extreme positions, the reversing valve 104 will reverse the discharge from the pump from discharge conduit 110 to discharge conduit 112. The operating rod 134 extends horizontally into the upper end of the reservoir 94 and is reciprocally supported by a pair of supporting members 136 carried by a horizontal supporting tray 138 rigidly affixed to the reservoir in any suitable manner. Reciprocal movement of the rod 134 is caused by an over center linkage mechanism generally designated by numeral 140 and which includes a link 142 pivotally supported from a bracket structure 144 at one end thereof which is fixed to the tray 138 and includes a pivot bolt or pin 146 mounting the link on the bracket for horizontal swinging movement about a generally vertical axis with the link 142 actually being two vertically spaced link members which extend in parallel relation to each other with one passing above and one passing below a generally horizontally disposed block 148 incorporated into the rod 134 and including a generally rectangular opening 150 therein having rounded corners which receives a roller 152 disposed between the two link members defining the link 142 so that as the link 142 is swung horizontally, the operating rod 134 for the reversing valve 104 will be reciprocated with the opening 150 and roller 152 providing limited relative movement between the operating rod 134 and the link 142 to enable the roller 152 to move in an arcuate path while the rod 134 reciprocates and to enable some lost motion between the link 142 and the rod 134.

To oscillate the link 142, a horizontally disposed control rod 154 is mounted from the tray 138 by supports 156 similar to the supports 136 with the rod 154 being generally parallel to the rod 134 and spaced horizontally therefrom with the end of the rod 154 projecting outwardly of the reservoir in opposed relation to the reversing valve 104. The control rod 154 includes a block 158 incorporated therein which has an opening 160 therethrough and which is received between the link members defining the link 142 with a roller 162 received in the opening 160, whereby reciprocatory movement of the control rod 154 will cause horizontal swinging of the link 142 and thus reciprocation of the operating rod 134 with the opening 160 in the block 158 being larger than the opening 150 in the block 148 to provide for the relative movements between the rod 154 and the link 142 and providing a limited lost motion connection between the rod 154 and the link 142.

For reciprocating the control rod 154, the outer end thereof is pivotally and slidably connected to one arm of a bell crank 164 by a connection 166. The bell crank 164 is supported at pivot point 168 attached to the rear wall of the reservoir 94 with the other arm of the bell crank 164 being pivotally connected by a pivot point 170 to an operating rod 172 which extends upwardly toward the walking beam 16 and which telescopes into a tubular member 174 pivotally attached to the walking beam at pivot point 176. The rod 172 includes a peripheral groove 178 which receives a pair of oppositely disposed rollers 180 mounted on the tubular member 174 by pivot arms 182 and spring biased towards each other by spring 184 which provides a break away connection between the rod 172 and the tubular member 174. This precludes breakage of the operating linkage in the event the walking beam is moved while the reversing valve is in stationary position and also enables lockout of the automatic operation of the reversing valve, thereby facilitating manual operation thereof when desired. The connection between the rod 172 and the bell crank 164 includes a pair of spaced collars 186 on the rod 172 located above and below the portion of the rod 172 which extends through a pivot connection 170 which enables variation of the stroke of the bell crank, thus enabling variation in the stroke of the control rod 154 thereby controlling the length of reciprocation of the operating rod 134 for the reversing valve 104. In order to lockout the operating linkage 172, 174, there is provided a lockout rod 188 which has a hook-like structure 190 at its upper end for connection with the stanchion or samson post and a socket-like structure 192 at the lower end for engagement with the pivotal connection 170 at the swinging end of the upper arm of the bell crank 164 thereby locking the bell crank stationarily and preventing pivotal movement thereof thereby locking the rod 154 and thereby preventing the operating rod 134 from being operated by the control rod 154. In this mode, a manually operated handle 194 can be mounted on the reversing valve 104 and engaged with the end of the operating rod 134 projecting therefrom remote from the reservoir 94. The handle 194 is provided with a rod 196 removably received in a pair of trunions 198 provided therefor on the reversing valve 104 with a spring 200 on the rod 196 biasing the rod 196 and thus the handle 194 to a neutral position when no pressure is exerted on the handle 194, thereby enabling manual reciprocation of the operating rod 134 with the operating rod 134 always returning to a neutral position so that neither of the piston and cylinder assemblies 70 and 72 are powered when no pressure is exerted on the short upwardly extending handle 194 which has been attached to the operating rod 134 by a suitable pivotal connection as at 202 which has sufficient vertical slot-like configuration to enable reciprocation of the rod 134 during forward and aft pivotal movement of the handle 194 is which pivotally supported by removable pin 201 through bracket 203.

To provide a snap action to the link 142, a rod 204 is pivotally connected to the end of the link 142 remote from the bracket 144 by a pivotal connection 206. The opposite end of the rod 204 is slidably received in a cylinder 208 which has an adjustable stop bolt 209 and a trunion 210 pivotally mounted in a bracket structure 212 carried by the tray 138 so that the cylinder 208 can pivot about a vertical axis paralleling the vertical axis of the pivot point 146 and the vertical axis of the pivot point 206. A coil spring 214 encircles the rod 204 and has one end exerting spring bias against the cylinder 208 and an adjustment nut 216 is provided for varying the compression on the spring. Thus, as the pivot point 206 passes a position with the link 142 aligned with the rod 204, the spring 214 will spring bias the link 142 in an over center manner towards its extreme position of movement in a "snap" action. This function is somewhat similar to the over center snap action of the linkage mechanism disclosed in my copending application. However, to cushion this movement and control the snap action, the rod 204 acts as a pump within the cylinder 208 which has an inlet 218 extending through the lower trunion and provided with a spring biased inlet ball valve 219 at the lower end thereof and an outlet 220 with the ball valve 221 at the upper trunion thereof which is communicated with a valve housing 222 having a needle valve 224 therein and a discharge nozzle 226 directing hydraulic fluid onto the spring 214 and associated structural components for lubrication thereof. By varying the position of the needle valve 224, the discharge from the pump defined by the rod 204 and cylinder 208 may be throttled to cushion the snap action of the mechanism as caused by spring 214 which has been compressed by initial movement of the rod 154 thereby controlling the speed of movement of the rod 134, thereby controlling movement of the reversing valve 104.

The pressure line 102 from the pump to the reversing valve is provided with a small tube 228 with a valve 229 which leads to a balance pressure gauge 230 to enable the pressure to the reversing valve to be observed when the reversing valve is in its opposite positions thereby assuring that the fluid pressure exerted will be balanced so that the same hydraulic pressure will be exerted in both directions of movement of the beam. Also, the return line from the reversing valve 104 to the reservoir 94 which is designated by numeral 108 may extend horizontally across the top portion of the reservoir and include a bypass line 232 which supplies hydraulic fluid to the valve inlet 218 of the pump cylinder 208 to assure proper supply of hydraulic fluid thereto. As illustrated, the conduit 122 interconnecting the cushioning cylinder 114 and the conduit 92 is located on the side of the bypass valve 132 toward the piston and cylinder assembly 70 and the conduit 92 is connected to the lower end of the piston and cylinder assembly 70, whereas the conduit 120 connected to the conduit 90 is on the side of the bypass valve 130 adjacent the piston and cylinder assembly 172 and the conduit 90 is connected to the upper ends of the piston and cylinder assemblies so that the inactive portion of each of the piston and cylinder assemblies will be connected to the return line 126 through the bypass valves and connecting conduit 124.

In operation, with the walking beam 16 with the counterbalance weight 234 thereon which normally biases the beam with the horse head to its uppermost position, the reversing valve will be in a position that fluid pressure will be exerted to move the horse head downwardly and thereafter, the linkage will automatically operate the reversing valve and cause oscillation of the beam. When in the automatic mode and double acting mode, the bypass valves 130 and 132 are positioned such that the connecting conduit 124 is closed. When in single acting mode, the bypass valves 130 and 132 are positioned so that flow from conduit 122 will be through conduit 92 to the piston and cylinder assembly 70 and return flow through conduit 120 will be from the piston and cylinder assembly 72 with the inactive portion of each piston and cylinder assembly 70 and 72 communicating with the reservoir 94 through the conduits 124 and 126. When the reversing valve is automatically reversed, the reverse flow, of course, occurs. Thus, the bypass valves enable the piston and cylinder assemblies to be automatically operated in either the double acting mode or single acting mode. The automatic linkage 140 may be locked out by utilizing the lockout rod 188 and the piston and cylinder assemblies operated by the attachable handle 194 either in the double acting mode or single acting mode with the reversing valve being biased normally to a neutral position so that release of pressure on the handle will enable the walking beam to stop at a neutral position or a position with the counterbalance weight at its lowest point.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination, a pump jack for well pumps comprising a support, a beam mounted on said support for pivotal movement about a generally horizontal transverse axis, a horse head at one end of said beam for connection with a polish rod of a well pump, a pair of hydraulic fluid pressure operated piston and cylinder assemblies connected to said beam for powering the beam about its pivot axis, a counterbalance weight on said beam on the opposite side of the transverse axis from the horse head, each of said piston and cylinder assemblies being powered from a hydraulic pump having a separate conduit connected to each end of the cylinders, a reversing valve communicating the pump with the conduits, and means interconnecting the reversing valve and the beam for controlling the position of the reversing valve in response to movement of the beam, said means controlling the reversing valve including a mechanical linkage, said linkage including adjustment means enabling variation in the stroke of the piston and cylinder assemblies, means cushioning high pressure hydraulic fluid moving from the reversing valve to the piston and cylinder assemblies for cushioning movement of said beam, said cushioning means including a cylinder communicated with said conduits, a piston movable in said cylinder in peripherally sealed relation thereto whereby said piston will move longitudinally in the cylinder in response to pressure changes in the conduits for cushioning movement of the hydraulic fluid in the conduits.

2. The structure as defined in claim 1 wherein said piston is freely movable and includes an orifice communicating opposite ends of the cylinder.

3. The structure as defined in claim 1 wherein said linkage connected with the reversing valve includes a spring biased over center linkage to snap the reversing valve to both of its positions.

4. The structure as defined in claim 3 wherein said over center linkage includes a pair of pivotally connected members with the aligned position of the members being a center position, a piston and cylinder assembly dampening movement of the members and pumping lubricant onto the linkage.

5. The structure as defined in claim 1 wherein said support includes a base including two longitudinal members, an upstanding stanchion rigid with the members and pivotally supporting said beam at its upper end, said longitudinal members defining the base including pivotal end portions, and longitudinally adjustable brace means interconnecting the pivotal end portions and the stanchion at a point adjacent its upper end to vary the position of the pivotal end portions of the longitudinal members defining the base thereby varying the supporting characteristics of the base to enable it to be installed at a well site without extensive levelling of the well site and providing footings for the base.

6. The structure as defined in claim 4 wherein said reversing valve includes an operating rod reciprocal in a horizontal manner, a control rid disposed parallel to the reciprocating rod from the reversing valve, said pair of pivotally connected members including a pair of links with one of the links being pivotally supported and including a lost motion connection with the two rods, the other of the links including a compression spring for biasing the links to an extreme position after movement past center, said dampening piston and cylinder assembly including a pump structure incorporated into one of the links for dampening force exerted on the links by the spring, and a needle valve manually adjustable to control the discharge of fluid from the pump thereby controlling movement of the link with which the pump is associated.

7. In a pump jack for well pumps in which the jack includes a base with an upstanding support, a beam mounted on said support for pivotal movement about a generally horizontal transverse axis, means at one end portion of the beam for connection with a pump operating rod, counterbalance means connected with the beam, hydraulic fluid pressure operated piston and cylinder means connected to said beam for pivoting said beam and reciprocating said pump operating rod, reversing valve means communicating said piston and cylinder means with a source of pressurized hydraulic fluid through hydraulic fluid pressure conduit means, and means controlling operation of said reversing valve in response to pivotal movement of said beam, that improvement comprising cushioning means in said hydraulic fluid pressure conduit means for cushioning movement of said beam adjacent both extreme positions of the beam during its pivotal movement, said cushioning means including a cylinder and piston freely movable therein, said cylinder having one end communicating with one conduit and the opposite end communicating with another conduit whereby increase in pressure in one conduit will cause an increase in pressure in the other conduit through movement of the piston.

8. The structure as defined in claim 7 together with flow restricting means between opposite end portions of said cylinder.

9. The structure as defined in claim 8 wherein said flow restricting means between opposite portions of said cylinder includes an orifice in the freely movable piston to enable restricted flow of high pressure fluid from one side of the piston to the other.

10. The structure as defined in claim 7 wherein said base includes a pivotal end portion and adjustable brace means interconnecting the pivotal end portion of the base and said upstanding support to adjust the configuration of the base.

* * * * *